United States Patent [19]

Bowes et al.

[11] 4,406,714

[45] Sep. 27, 1983

[54] HEAT TREATMENT OF METALS

[76] Inventors: Robert G. Bowes, 7 Riverside Crescent, Otley, West Yorkshire; Keith Bennett, 18 Aspen Close, Long Lee, Keighley, West Yorkshire; Paul F. Stratton, 42 Park Lea, Bradley Grange, Bradley, Huddersfield, West Yorkshire, all of England

[21] Appl. No.: 258,083

[22] Filed: Apr. 27, 1981

[30] Foreign Application Priority Data

May 2, 1980 [GB] United Kingdom ..... 8014576

[51] Int. Cl.[3] ..... C21D 1/48

[52] U.S. Cl. ..... 148/16.5; 148/16.6

[58] Field of Search ..... 148/16, 16.5, 16.6, 148/16.7

[56] References Cited

U.S. PATENT DOCUMENTS

| | | | |
|---|---|---|---|
| 3,216,869 | 11/1965 | Koistinen | 148/16.6 |
| 4,145,232 | 3/1979 | Solomon | 148/16.5 |
| 4,154,629 | 5/1979 | Asai et al. | 148/16.6 |

OTHER PUBLICATIONS

A Dictionary of Metallurgy, A. D. Merriman, 1958, p. 14.

The Making, Shaping and Treating of Steel, U.S. Steel, 1964, p. 1039.

*Primary Examiner*—John P. Sheehan

*Attorney, Agent, or Firm*—David L. Rae; Larry R. Cassett

[57] ABSTRACT

Ferrous metal is treated by austenitic nitro-carburizing in a heat treatment furnace. A suitable atmosphere is created by admitting to the furnace nitrogen; ammonia; and a liquid or vaporous organic compound of carbon, hydrogen and oxygen. The atmosphere is maintained at a temperature in the range 690° to 750° C. The organic compound is typically methanol and the atmosphere typically comprises nitrogen, carbon monoxide, hydrogen and free ammonia as well as small amounts of methane, carbon dioxide and water vapor.

After being removed from the furnace, the ferrous metal is quenched. It has an outer surface layer of white, scuff-resistant, epsilon compound and an inner carbonitrided case containing austenitic and martensitic zone. The ferrous metal may then be treated to convert austenite to martensite or lower bainite.

12 Claims, 1 Drawing Figure

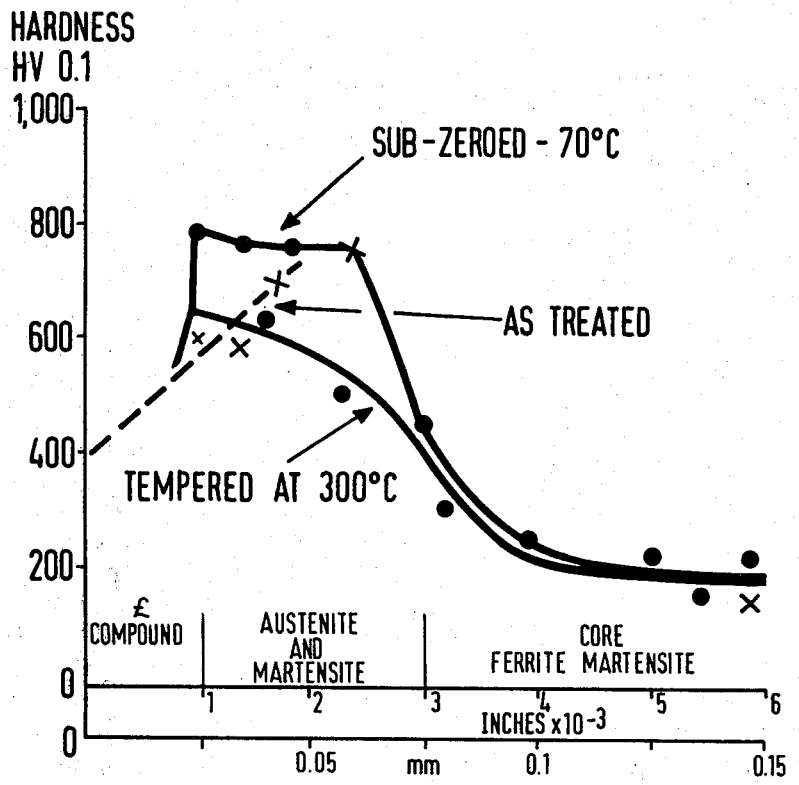
TYPICAL MICRO-HARDNESS TRAVERSES ON AUSTENITIC NITRO-CARBURISED MILD STEEL SAMPLES.

HEAT TREATMENT OF METALS

BACKGROUND OF THE INVENTION

This invention relates to the heat treatment of metals.

One method of heat treatment, in daily commercial use, is the carbonitriding of low carbon steels. If the components to be carbonitrided are of relatively thin cross-section they tend to become physically distorted. Attempts have therefore been made to find alternative heat treatment processes to carbonitriding in order to avoid this problem of distortion. One such process is ferritic nitro-carburising. It has been found that the process of ferritic nitro-carburising of mild steel components enables the problem of distortion to be overcome and enables a scuff-resistant surface finish to be obtained. One drawback of the process of ferritic nitro-carburising is, however, that the components, after treatment by the process, tend to have poor indentation resistance. Another process which overcomes the aforementioned problem of distortion is austenitic nitro-carburising. Moreover, mild steel components can be given good scuff-resistance and indentation-resistance by being subjected to austenitic nitro-carburising.

In order to perform a process of austenitic nitro-carburising of components of mild or other low carbon steel, it has hitherto been the practice to produce the necessary atmosphere by adding ammonia to an atmosphere produced by an endothermic generator and to supply the resultant gas mixture (or the two gas streams separately) to a furnace (typically a sealed quench furnace) in which the treatment is performed. Endothermic generators do however have certain disadvantages. In particular, they can be expensive to maintain, and skilled operatives are often required for this purpose; they are relatively expensive items of capital equipment which have a finite life; and they are quite bulky and take up floorspace which could otherwise be used for a different purpose in a heat treatment workshop.

OBJECT OF THE INVENTION

It is an object of the invention to provide a suitable atmosphere for austenitic nitro-carburising of steel or other ferrous metal without using an endothermic generator.

THE INVENTION

According to the present invention there is provided a method of austenitic nitro-carburising ferrous metal in a heat treatment furnace, in which method a suitable atmosphere is created by admitting to the furnace nitrogen; ammonia; and a liquid or vaporous organic compound of carbon, hydrogen and oxygen and is maintained at a temperature in the range 690° to 750° C.

The said compound is preferably methanol. Preferably for each unit volume of ammonia admitted to the furnace, two unit volumes of nitrogen are supplied thereto, and for each (standard) cubic foot of nitrogen, one-sixtieth of a liter of methanol (measured as a liquid) is supplied to the furnace. In other words, preferably for each 2 moles of nitrogen admitted to the furnace, 2 moles of methanol and 1 mole of ammonia are admitted to the furnace. The methanol may be dripped into the furnace, or may be vaporised upstream of the furnace and introduced as a vapour into the furnace.

Typically, the nitrogen for use in the process is stored in liquid state in an insulated vessel and vaporised upstream of the furnace.

In the furnace the methanol decomposes and a gas mixture comprising nitrogen, hydrogen, carbon monoxide, carbon dioxide, water vapour and methane is formed. Furthermore, most but not all of the ammonia decomposes to form nitrogen and hydrogen. Thus, the furnace atmosphere comprises nitrogen, hydrogen, carbon monoxide, carbon dioxide, water vapour, methane and ammonia. Preferably, the atmosphere includes 7 to 11% by volume of carbon monoxide; from 30 to 40% by volume of hydrogen, and from 6 to 11% by volume of free ammonia. With such levels of carbon monoxide, hydrogen and free ammonia, the atmosphere typically includes from 1 to 2% by volume of carbon dioxide and from 2 to 3% by volume of methane and has a dew point between −5° C. and +5° C. The balance consists essentially of nitrogen. Such an atmosphere may be formed in, for example, a sealed quench furnace at 700° C. by admitting to the furnace 120 cubic feet per hour of nitrogen, 60 cubic feet per hour of ammonia and 2 liters per hour of methanol (measured as liquid). In one example, we have found that a furnace atmosphere, comprising 36% by volume of hydrogen; 9% by volume of carbon monoxide; 8.5% by volume of ammonia; 2.6% by volume of methane; 1.3% by volume of carbon dioxide and balance nitrogen, with a dew point in the range −2° C. to +2° C., is produced. If desired the proportion of free ammonia in the furnace may be controlled by using a dissociation burette.

Typically, the components to be nitro-carburised may be kept in the atmosphere at a temperature of 690° C. to 750° C. for a period of 2 hours. During this period a relatively thin, white, outer layer is formed at the surfaces of the components (or other work) to be treated. This layer is of the kind referred to in the art as being of epsilon compound, and includes oxygen, nitrogen and carbon. The outer layer has scuff-resistant properties. In addition to the outer layer there is an inner carbo-nitrided case surrounding a ferritic core. After quenching the components in oil, the case has two zones, one austenitic and the other martensitic. It is then desirable to transform the austenite to lower bainite or martensite so as to optimise the mechanical properties of the case. The transformation to lower bainite is typically effected isothermally by tempering at 250° C. or above for at least one hour (and preferably at 300° C. or above for at least two hours). The transformation to martensite is effected by reducing the temperature of the components to −70° C. or below, and then allowing the components to return to ambient temperature. In order to prevent the austenite from stabilising it is desirable to start to reduce the temperature of the components to −70° C. or below within two hours of completion of the (oil) quench.

Typically, if the components are of mild steel and if they are maintained in the furnace atmosphere at 700° C. for two hours, the (outer) layer of epsilon compound has a depth of from 0.0010 to 0.0012 inches and the (inner) case has a depth of from 0.005 to 0.006 inches.

Typical micro-hardness traverses on samples of mild steel that has been subjected to austenitic nitro-carburising in accordance with the invention are shown in the accompanying drawing which is a graph showing how the hardness (HV×0.1) of the samples vary with increasing depth of sample.

The results for three samples are shown in the graph. All samples were maintained for two hours in an atmosphere, at 700° C., of the kind described herein. The austenite of a first sample was transformed isothermally to lower bainite by tempering for two hours at 300° C., and the austenite of a second sample was transformed to martensite by reducing the temperature of the sample to −70° C., while the third sample was given no treatment to transform its austenite. The first sample has a surface more ductile but less hard than that of the second surface.

We claim:

1. A method of austenitic nitro-carburising ferrous metal in a heat treatment furnace comprising the steps of heating said furnace to a temperature in the range of 690°–750° C.; and introducing nitrogen; ammonia; and a liquid or vaporous compound of carbon, hydrogen and oxygen into the furnace to form an atmosphere comprised of nitrogen, methane, 6–11% free ammonia, 7–11% carbon monoxide, 1–2% carbon dioxide and hydrogen and has a dew point of −5°–+5° C. without the separate addition of methane such that a scuff resistant epsilon compound layer including oxygen, nitrogen and carbon is formed on the surface of said ferrous metal.

2. A method according to claim 1, in which the said compound is methanol.

3. A method according to claim 2, in which for each 2 moles of nitrogen admitted to the furnace, 2 moles of methanol and 1 mole of ammonia are admitted to the furnace.

4. A method according to claim 1, in which an atmosphere is formed in the furnace including 30 to 40% by volume of hydrogen, and from 6 to 11% by volume of free ammonia.

5. A method according to claim 4, in which the atmosphere additionally includes from 2 to 3% by volume of methane.

6. A method according to claim 4, in which the ferrous metal is maintained in the atmosphere for at least two hours.

7. The method defined in claim 1 additionally comprising the steps of quenching the ferrous metal, and transforming austenite in the quenched metal to another phase.

8. A method according to claim 7, in which after quenching austenite in the metal is transformed isothermally to lower bainite.

9. A method according to claim 8, in which the transformation is effected by tempering the metal at a temperature of at least 250° C. for at least one hour.

10. A method according to claim 8, in which the metal is tempered at a temperature of at least 300° C. for at least 2 hours.

11. A method according to claim 7, in which, after quenching, austenite in the metal is transformed to martensite.

12. A method according to claim 11, in which the transformation is effected by reducing the temperature of the metal to −70° C. or below.

* * * * *